United States Patent [19]

Minialoff et al.

[11] Patent Number: 4,700,511

[45] Date of Patent: Oct. 20, 1987

[54] PRESSURE RELIEF WALL ASSEMBLY

[75] Inventors: Joseph M. Minialoff, 25 Edgehill Rd., Islington, Ontario, Canada, M9A 4N1; Leonard E. Blendick, Toronto; Thomas C. McCavour, Islington, both of Canada

[73] Assignee: Joseph M. Minialoff, Islington, Canada

[21] Appl. No.: 617,295

[22] Filed: Jun. 4, 1984

[30] Foreign Application Priority Data

Jun. 7, 1983 [CA] Canada ..... 429852

[51] Int. Cl.[4] ..... E04C 2/46; E04B 1/98

[52] U.S. Cl. ..... 52/1; 52/98

[58] Field of Search ..... 52/1, 476, 98, 232; 49/141

[56] References Cited

U.S. PATENT DOCUMENTS

| | | | |
|---|---|---|---|
| 2,989,786 | 6/1961 | Cuss . | |
| 3,258,887 | 7/1966 | Mostoller | 52/547 |
| 3,807,106 | 4/1974 | Reinhardt | 52/98 |
| 4,094,108 | 6/1978 | Scott | 52/1 |
| 4,413,458 | 11/1983 | Ting | 52/481 |
| 4,597,229 | 7/1986 | Minialoff | 52/1 |

FOREIGN PATENT DOCUMENTS

| | | |
|---|---|---|
| 928027 | 6/1973 | Canada . |
| 1067667 | 12/1979 | Canada . |
| 1087360 | 1/1980 | Canada . |

*Primary Examiner*—John E. Murtagh

*Attorney, Agent, or Firm*—Rogers, Bereskin & Parr

[57] ABSTRACT

A pressure relief wall assembly has a wall panel, one end of which is permanently secured to a frame. A plurality of elements secure a second end of the wall panel to the frame, and these elements fail when an excess pressure is applied to the wall panel. A retaining member is provided so that, when excess pressure is applied to one of the two sides of the wall panel, the second end of the wall panel is retained until a further increase of pressure occurs. The retaining member then releases the second end of the wall panel. This enables the wall assembly to be designed for different release pressures in blow-in and blow-out modes, so that no excess load is applied to a support frame in either mode.

17 Claims, 13 Drawing Figures

PRESSURE RELIEF WALL ASSEMBLY

This invention relates to a pressure relief wall assembly. This invention more particularly but not exclusively; relates to a pressure relief wall assembly for large structures, such as generating stations.

Such a pressure relief assembly is intended to relieve the pressure on the primary framing of a structure created by abnormal conditions, while simultaneously ensuring that no airborne missiles or debris are released. The abnormal conditions could be an explosion within or outside a building, which blows the wall inwards or outwards, or extreme weather conditions, e.g. a tornado, which might blow a wall inwards or outwards.

The pressure relief wall assembly of the present invention is sometimes required for large buildings, such as electricity generating stations. It enables the main structure and foundations to be designed to withstand only normal loads and the release load for the pressure relief wall system. The main structure and foundation do not have to be capable of withstanding the load applied by such abnormal conditions as those outlined above.

According to the present invention, there is provided a pressure relief wall assembly comprising a wall panel having first and second ends, the first end, in use, being permanently secured to a frame, and fastener means which comprises;

a plurality of elements, which, in use, releasably fasten the second end of the wall panel to the frame and which fail when excess pressure is applied to either side of the wall assembly; and a retaining means comprising a retaining member and an engagement member mounted, in use, between the wall panel and the frame, which retaining means in use, when excess pressure is applied to one side of the wall panel does not obstruct deflection of the second end, and for deflection in the other direction, retains the second end of the wall panel after failure of said elements, and which deflects and releases said second end after a further increase in the pressure applied to said other side of the wall panel.

The present invention also provides a pressure relief wall assembly comprising a wall panel with a central portion of the panel, in use, being permanently secured to a frame, and fastener means which comprises:

a plurality of elements, which, in use, releasably fasten the ends of the wall panel to the frame and which fail when excess pressure is applied to either side of the wall assembly;

and at either end of the panel a retaining means comprising a retaining member and an engagement number mounted in use, between the wall panel and the frame, which retaining means, in use, when excess pressure is applied to one side of the wall panel does not obstruct deflection of the second end and for deflection in the other direction, retains a respective end of the wall panel after failure of said elements, and which deflects and releases the respective end after a further increase in the pressure applied to said other side of the wall panel.

The pressure relief wall system or apparatus may be installed in a single span or a double span condition. The two spans of a double span arrangement may be of different lengths. Preferably the wall panel includes inner and exterior panels secured together by subgirts and, in use, the pressure relief wall assembly is secured to a frame comprising girts or main girders.

The pressure relief wall system will blow in or blow out at predetermined release pressures. The blow in and blow out release pressures may be equal or of different magnitudes.

The wall system can be made so as to deflect in or deflect out within predetermined limits at predetermined loads.

Typically, the pressure relief is achieved by a two stage release system. The load for each stage can be controlled. Stage one release includes the connection of the liner panel to a girt at the frame using a riveted release assembly. The release load can be controlled by varying the size, spacing and material of the rivets. In addition a hook is incorporated to reduce shear in the blow out mode. Further control is possible by changing the angle of the hook. Stage two release can include the connection of the exterior panel to the liner panel and the girts using subgirts installed at a predetermined spacing. The release load can be controlled by varying the configuration and thickness of the profile and the spacing of the intermediate subgirts.

In a single span construction the liner panel is rigidly connected to a girt at one end and connected with the riveted release assembly at the other end. The exterior panel is rigidly connected by means of a subgirt to a girt at one end and by means of a subgirt to the liner panel at the other end.

At a predetermined blow out pressure the single span liner panel and the exterior panel bend out. The riveted release assembly releases first by failing in combined tension and shear and, then unhooking. A buckle then forms in the exterior sheet adjacent to the fixed end and the wall system blows out forming a "J" shape while still remaining attached to the girt at the fixed end.

At a predetermined blow in pressure the single span liner panel and the exterior panel bend in. The riveted release assembly releases first by failing in shear. A buckle then forms near the middle of the span and the wall system blows in forming a "V" shape while still remaining attached to the girt at the fixed end.

In a double span construction the liner panel is rigidly connected to a girt at the centre support and connected with the release assembly at the end supports. The exterior panel is rigidly connected by means of a subgirt to the girt at the centre support. The exterior panel is also connected to the liner panel by means of subgirts at either end support and at one intermediate location on each span. At a predetermined blow out pressure the double span liner panel and the exterior panel bend out. The riveted release assembly releases first by failing in combined tension and shear, and then unhooking. A buckle then forms in the exterior sheet at tne fixed center support and the wall system blows out forming a "V" shape while still remaining attached to the firt at the fixed centre support.

At a predetermined blow in pressure the double span liner panel and the exterior panel bend in. The riveted release assembly releases first by failing in shear. A buckle then forms in the exterior sheet near the middle of the span and the wall system blows in forming a "W" shape while still remaining attached to the girt at the fixed centre support.

Preferably, the subgirt which is used for the fixed connection in either the single or double span construction has a "Z" configuration which allows it to bend and deform without pulling away from the girt to which it is connected.

In known double panel controlled release systems, failure occurred when the liner panel pulled away from a clamp which connected the liner to the supporting structural steel. In a normal building installation the supporting structural steel may be misaligned such that the liner has a variable lap length. In addition there may be difficulty in providing a consistent clamping pressure between the liner and the structural supports. The release assembly of the present invention provides a means of installation on misaligned steel and also a means of controlled consistent release by varying the size, spacing and material in the rivets and the shape of the hook.

Pressure relief is achieved by a two stage release system. The load for each stage can be controlled.

For a better understanding of the present invention and to show more clearly how it may be carried into effect, reference will now be made, by way of example, to the accompanying drawings which show an embodiment of the present invention and in which.

Figure 1:
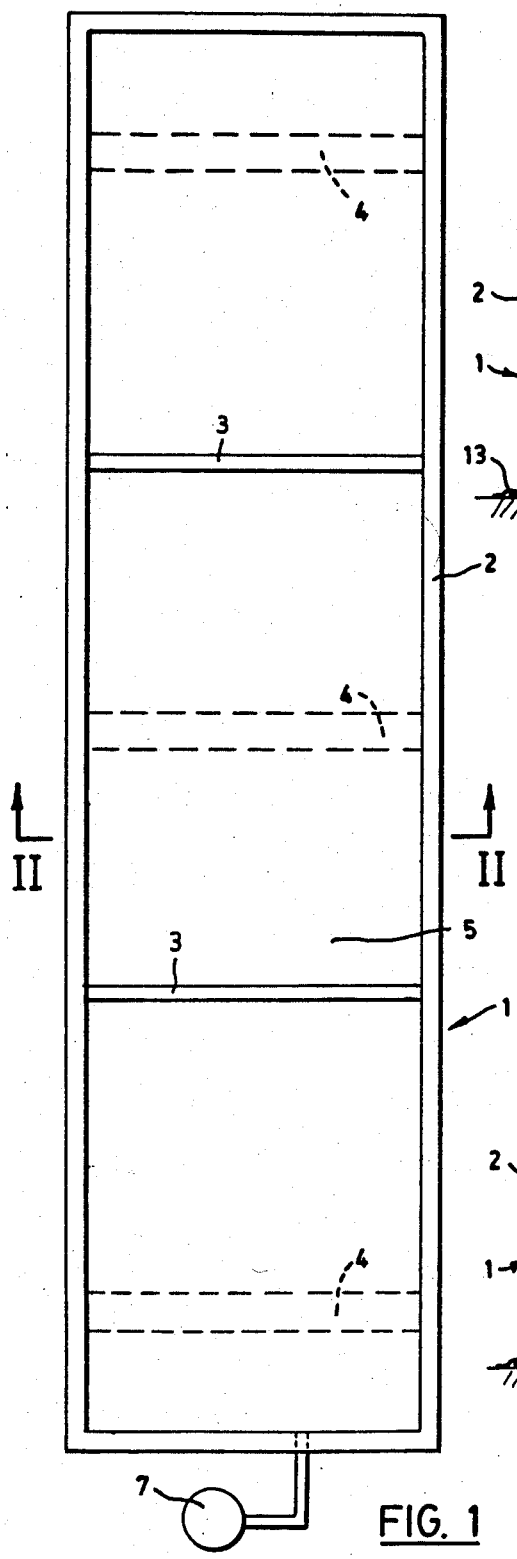
FIG. 1 shows a plan view of a double panel assembly according to the present invention in a test box.
Figure 3:
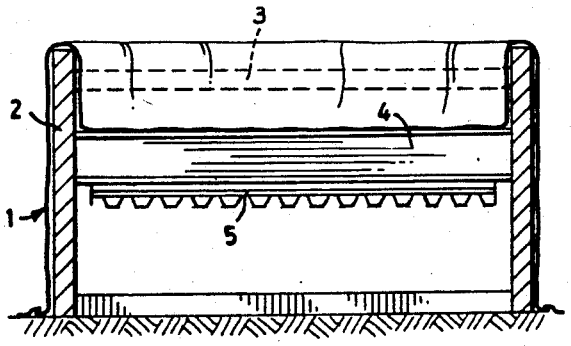
FIG. 3 shows a cross-section similar to FIG. 2, for a blow-out mode.

FIG. 1 shows a vacuum test box 1, which comprises a rectanqular body 2 braced with wooden struts 3. Structural steel supports 4, which are only shown in outline in FIG. 1, simulate part of the steel framework of a building. A pressure release wall apparatus 5 is secured to the steel supports 4, with its normal vertical axis disposed horizontally and lengthwise along the test box. For a blow-in test, the pressure release wall apparatus 5 is secured on top of the steel supports 4 with its exterior surface uppermost. When a vacuum is created in the test box 1 below the pressure relief wall apparatus 5, atmospheric pressure serves to provide the necessary external pressure of the apparatus. For a blow-out test, the pressure relief wall apparatus 5 is mounted as shown in FIG. 3. The apparatus is then secured below the steel supports 4, with its usual exterior surface at the bottom. Again, upon evacuating the test box 1, atmospheric pressure serves to deflect the pressure relief wall apparatus 5 downwards. As shown diagrammatically in FIG. 1, a vacuum pump 7 is provided for the test box.

Figure 2:
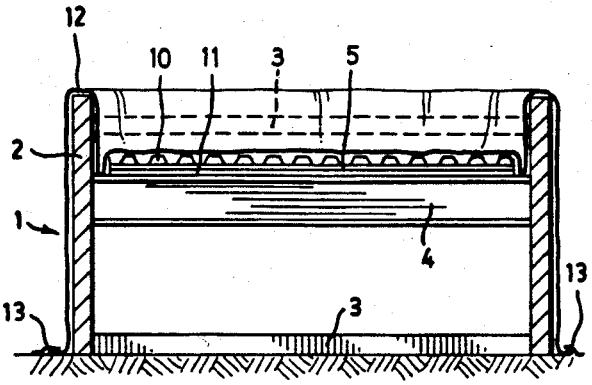
FIG. 2 shows a section along the line II—II FIG. 1, for a blow-in mode.

As shown in FIG. 2, the wall apparatus or panel comprises an exterior panel 10 and an inner, liner panel 11. For test purposes, a polythene sheet 12 is laid over the vacuum box and the test panel, and is taped to the floor at 13.

Figure 4:
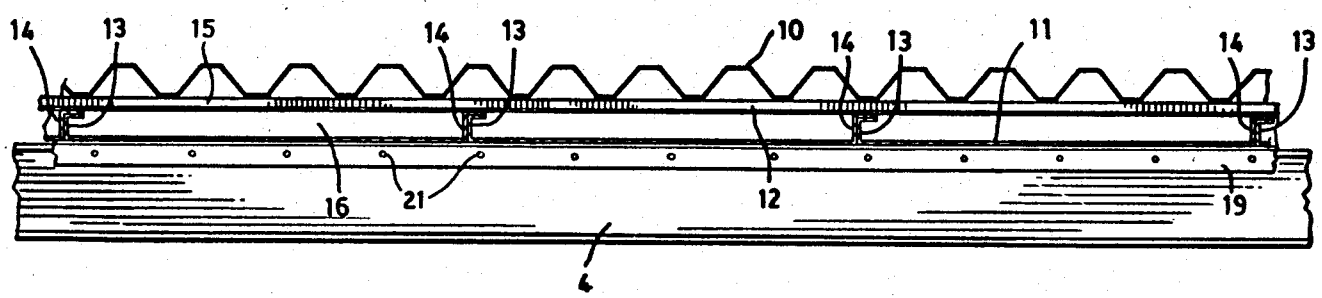
FIG. 4 shows on a large scale part of the section of FIG. 2.

FIG. 4 shows details of the panel assembly. The exterior panel 10 is corrugated. In normal use, the corrugations extend vertically, but in the test box they are arranged horizontally. In FIG. 4, three liner panels 11 are shown. Each panel 11 has a C-shaped portion 13 along its left edge and a corresponding Z-shaped portion 14 along its right-hand edge. These portions 13 and 14 enable adjacent liner panels 11 to be coupled along their adjacent edges. Two members 15 of a Z-shape cross-section are disposed between the exterior panel 10 and the liner panels 11. The two members 15 are secured to the exterior panel 10 and the liner panels 11 and are disposed symmetrically on either side of the central structural steel support 4. At each end of the exterior panel 10, a Z-shaped member 16 secures the exterior panel 10 to the liner panels 11. The member 16 is secured by screws 17 to the exterior panel 10 and by screws 18 to the liner panels 11. The screws 18 also serve to secure an L-shaped member 19 to the inner side of the liner panel 11.

Figure 7:
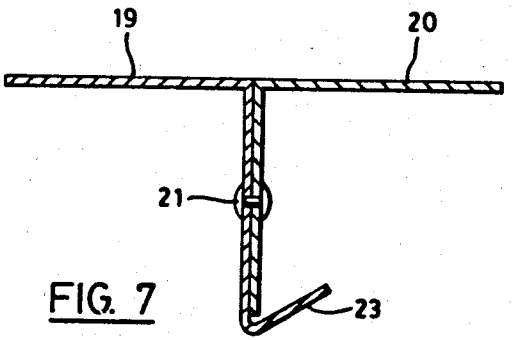
FIG. 7 shows on a larger scale the part X of FIG. 6.

Referring to FIG. 7, an L-shaped member 20, corresponding to the L-shaped member 19, is secured to each of the outer steel supports 4. The L-shaped members 19 and 20 are secured together by rivets 21. The L-shaped member 19 is additionally provided with a hook-shaped portion member 23. The L-shaped member 19 serves as an engagement member that engages the L-shaped member 20 serving as an abutment member. The portion 23 is intended to restrain the assembly in the blow-out mode, and this is explained in detail later.

Figure 5:
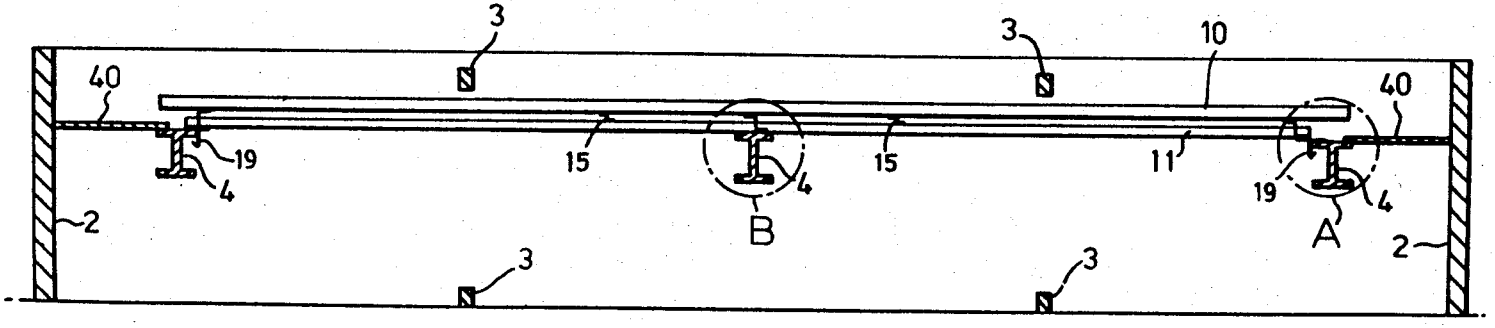
FIG. 5 shows a section, normal to the section of FIGS. 2 and 4, of the double panel assembly in the test box.
Figure 8A:
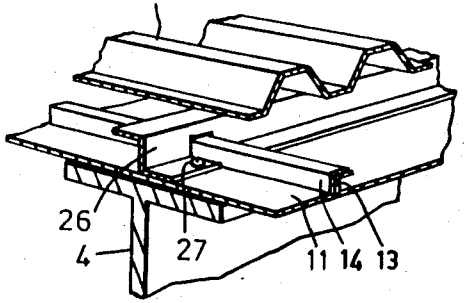
FIG. 8 shows the part B of FIG. 5, on an enlarged scale.
Figure 8:
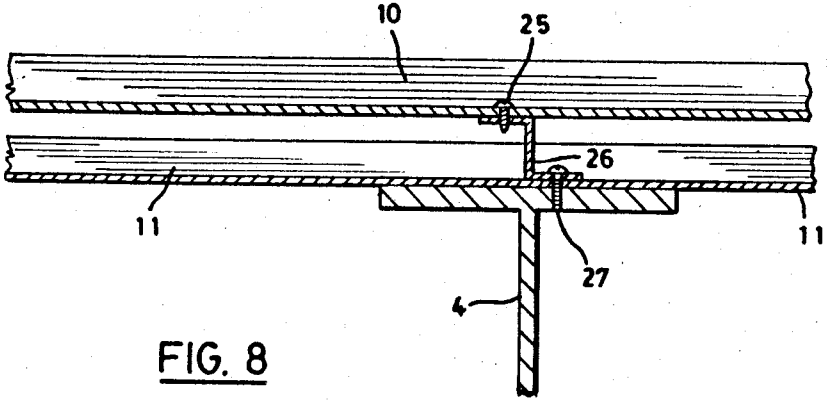

Referring to FIG. 5, the two-span construction shown is supported at its midpoint on the central steel support 4. FIG. 8 shows on a larger scale the central zone B of FIG. 5. The exterior panel 10 is secured by screws 25 to a Z-shaped member 26, which is located in the liner panel 11 and extends perpendicular to and crosses the edge proportions 13 and 14 of adjacent liner panels 11. Screws 27 secure together the Z-shaped member 26 the liner panels 11 and the central steel support 4.

Figure 6:
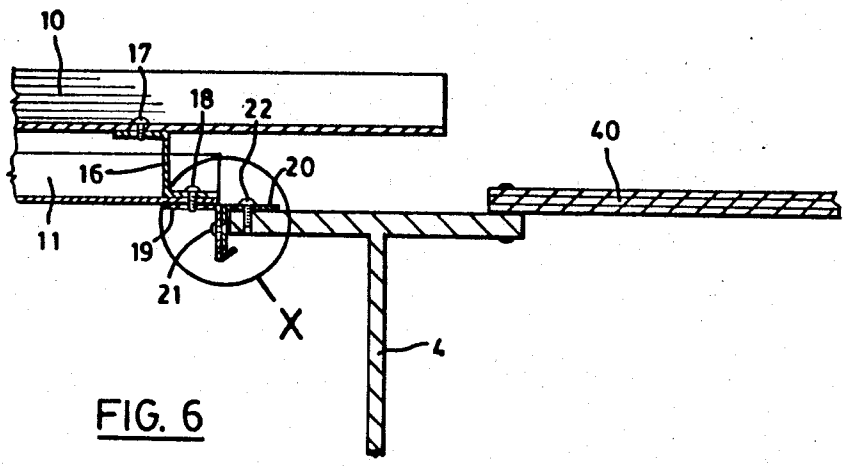
FIG. 6 shows on an enlarged scale parts A of FIG. 5.

In order to complete the construction for test purposes, a sheet of plywood 40 is provided at either end between each end support 4 and the test box 1 (FIG. 6).

The different types of behaviour for both single and double-span constructions in both blow-in and blow-out modes will now be described, with reference to FIGS. 9–12. On load, the liner panels 11, which are flat except for their edges, provide negligible resistance to the load. The uniform geometry and section properties of the exterior panel 10 consequently provides nearly equivalent performance under positive or negative loads.

Figure 9:
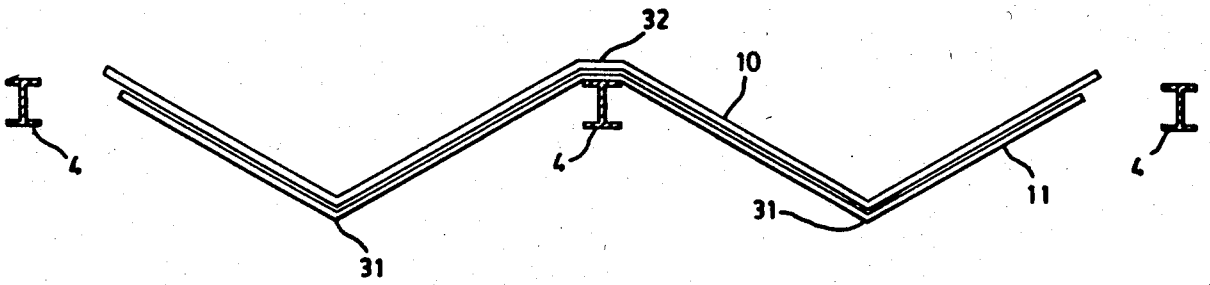
FIGS. 9 and 10 show the failure mechanism, for a double span in blow-in and blow-out modes; and L.
Figure 10:
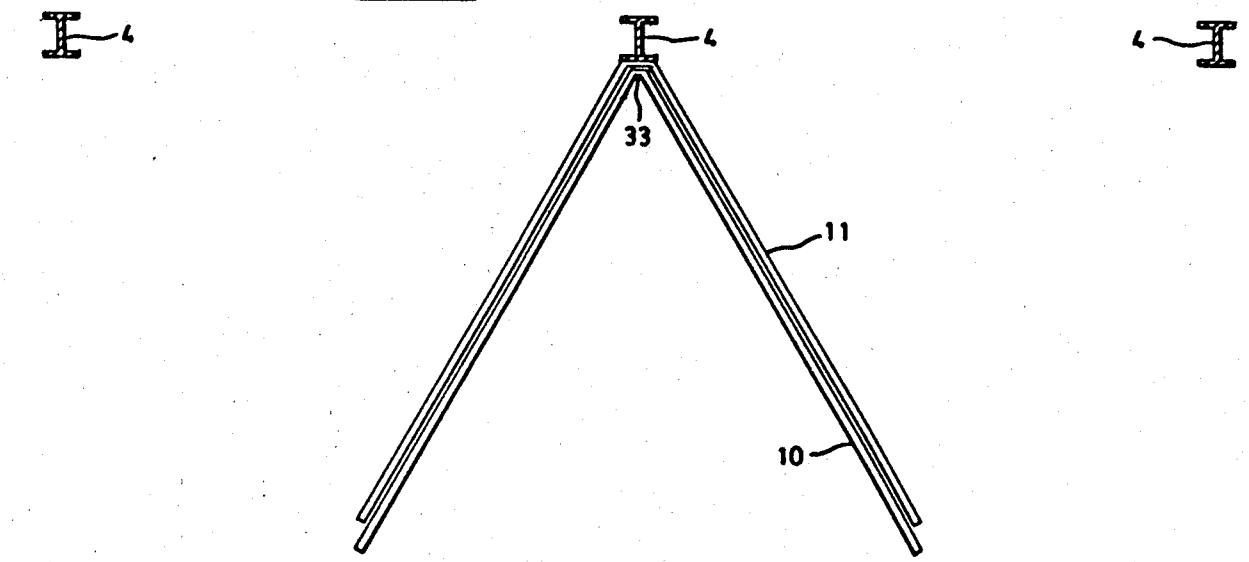

With reference to FIG. 9, in the blow-in mode for a two-span construction, the load on the rivets 21 at either end support 4 increases as the pressure or load applied from the outside increases. Eventually, the rivets 21 fail in shear. The ends of the exterior panel 10 are then free to deflect inwards until they abut the end supports 4. The construction is then stable until the pressure or load has built up sufficiently to cause plastic hinges 31 to develop at the midpoint of each span and a plastic hinge or hinges 32 to develop at the central support 4. As these hinges develop, the ends of the panel 10 are pulled away from the end steel supports 4, until they are free from these supports 4. The whole panel assembly is then in the position shown in FIG. 9 and free to wrap itself around the central steel support 4, thereby releasing, for example, pressure applied by abnormal wind load. In this blow-in mode, the hooks 23 are not engaged with the L-shaped members 20 at either end.

In the blow-out mode, an internal pressure increases until again the rivets 21 fail in combined tension and shear at either end. However in this case the ends of the assembly are still retained by the hooks 23, which engage the L-shaped members 20. The assembly is then stable until the internal pressure has increased sufficiently to cause the end of the assembly to pull away and bend the hooks 23. A plastic hinge 33 then forms in the middle of the panel assembly, and the two-spans are blown outwards to form the V-shape shown in FIG. 10, thereby releasing the applied internal pressure.

Figure 11:
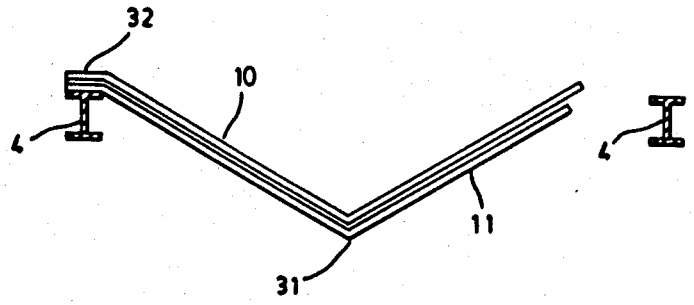
FIGS. 11 and 12, show the failure mechanism, for a single span in blow-in and blow-out modes.
Figure 12:
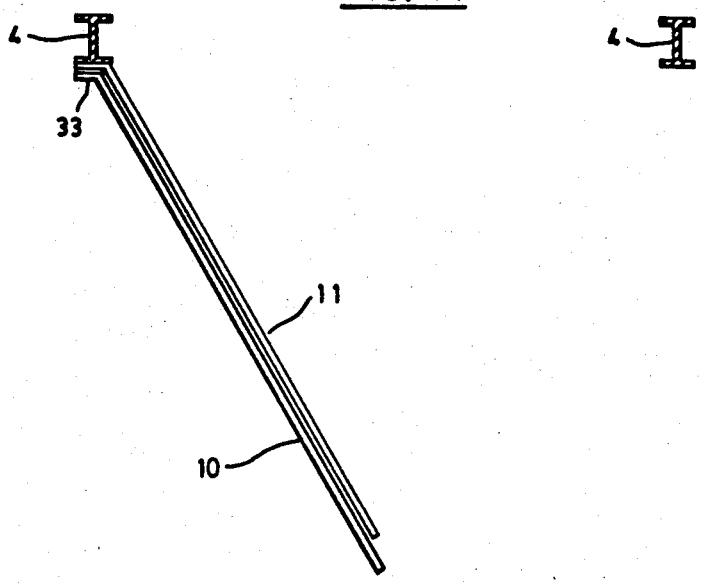

The mechanism for a single-span construction in both blow-in and blow-out modes is similar. As shown in FIG. 11, after the rivets 21 have been sheared at the right-hand end by excessive external pressure, plastic hinges develop at 31 and 32. The free end of the single-span then pulls away from the righthand support 4 to enable it to be deflected inwards. In the blow-out mode, again the rivets 21 fail due to increasing external pressure so that the load is applied to the hook 23. Once the pressure has exceeded a predetermined value, the hook 23 is straightened out and the single-span is deflected inwards, as shown in FIG. 12.

In all cases, the fixed line of fasteners 27 at the central support 4 for the two-span construction (or the lefthand support 4 for a single-span construction) prevent the panel assembly from blowing away. Thus, no part of the panel assembly is permitted to become a potentially dangerous airborne missile.

There are two ways in which the pressure at which the panel assembly ultimately fails is controlled. Firstly, the pressure at which the rivets 21 fail can be varied by altering the number, size, spacing and material of the rivets 21. The pressure at which the panel assembly will buckle can be controlled by varying the location of the Z-shaped members 15 relative to the central support 4, for a two-span construction. The buckling pressure decreases as the Z-shaped members 15 are moved further from the central support 4.

Both the exterior panels 10 and the liner panels 11 could have different sections to those illustrated in the drawings. In particular, the liner panels 11 could be essentially flat with shallow ribbing or fluting. For each panel 11, an engagement flange could be provided along one edge perpendicular to the main body of that panel and an engagement channel of complimentary shape could be provided along an opposite edge. The engaging or coupling portions could alternatively be generally V-shaped. Also, the liner panels 11 could be perforated. The exterior panels 10 can also have a variety of different cross-sections and a variety of different coupling or engagement sections can be provided along opposite edges of the panels 10, all of the panels 10 being provided with corresponding and complimentary coupling sections.

The Z-shaped members 15 can be replaced by members with a top hat cross-section, which may be riveted or screwed to the liner panels 11 and exterior panels 10.

We claim:

1. A pressure relief wall assembly comprising a wall panel the terminology having ends and sides with a central portion of the panel, in use, being permanently secured to a frame, and fastener means which comprises:

securing means comprising a plurality of elements, which, in use, releasably fasten the ends of the wall panel to the frame and which fail when a first excess pressure is applied to either side of the wall panel;

and at either end of the panel a retaining means each of which retaining means comprises a retaining member and an engagement member mounted, in use, between a respective end of the panel and the frame, with the retaining member including a portion extending in the direction parallel to the plane of the wall panel and abutting the engagement member, whereby for deflection of the respective panel end in one direction the retaining member leaves the retaining member without obstructing the deflection, and for deflection in the other direction, after failure of said elements, the retaining member retains the respective end of the wall panel and prevents any substantial movement thereof, and the retaining member deflects so as to be released from the respective engagement member, thereby releasing the respective end to permit the applied pressure to dissipate, when a second excess pressure greater than the first excess pressure is applied to the other side of the panel after a further increase in the pressure applied to the wall panel in said other direction above a second excess pressure greater than the first excess pressure.

2. A pressure relief wall assembly comprising a wall panel having first and second ends, the first end in use being permanently secured to a frame, and fastener means for fastening the second end to the frame, the fastener means comprising: a plurality of securing elements, for releasably securing the second end of the wall panel to the frame, which securing elements, in use, fail when a first excess pressure is applied to either side of the wall panel; and retaining means which comprises a retaining member and an engagement member mounted, in use, between the second end of the wall panel and the frame, with the retaining member including a portion extending in the direction parallel to the plane of the wall panel and abutting the engagement member, whereby for deflection of said second end in one direction, the retaining member leaves the engagement member without obstructing the deflection, and for deflection in the other direction, after failure of the securing elements, the retaining means retains said second end and prevents any substantial movement thereof and the retaining member deflects so as to be released from the engagement member, thereby releasing said second end, to permit the applied pressure to dissipate when a second excess pressure, greater than the first excess pressure, is applied to the wall panel in said other direction.

3. A pressure relief wall assembly comprising a wall panel having first and second ends, the first end, in use, being permanently secured to a frame, and fastener means which comprises:

a plurality of elements, which, in use, releasably fasten the second end of the wall panel to the frame and which fail when a first excess pressure is applied to either side of the wall panel; and a retaining means, which comprises a retaining member, which includes a planar portion and a hook-shaped portion contiguous with a free end of the planar portion, and a planar engagement member, which retaining means in use, is secured between the frame and the wall panel with the planar engagement member engaging said hook-shaped portion to retain the wall panel and with the planar portion of the retaining member and the engagement member extending generally perpendicularly to the plane of the wall panel, whereby, in use, after failure of said elements, for deflection in one direction the engagement member freely disengages from the retaining member and for deflection in the other direction the hook-shaped portion retains the engagement member until a second excess pressure greater than the first excess pressure is applied sufficient to deflect the hook-shaped portion so as to release the engagement member.

4. A pressure relief wall assembly comprising a wall panel having first and second ends, the first end in use being permanently secured to a frame, and fastener means for fastening the second end to the frame, the fastener means comprising: securing means for releasably securing the second end of the wall panel to the frame, which securing means, in use, fails when a first excess pressure is applied to either side of the wall panel; and a retaining means comprising a retaining member including a hook-shaped portion which permits deflection of said second end in one direction, and for deflection in the other direction, retains said second end after failure of the securing means, the hook-shaped portion deflecting and releasing said second end, to permit the applied pressure to dissipate, when a second excess pressure, greater than the first excess pressure, is applied to the wall panel in said other direction.

5. A pressure relief wall assembly as claimed in claim 4, wherein the retaining member is L-shaped, one side of the retaining member including the hook-shaped portion and the other side thereof, in use, being secured to the wall panel or the frame, and wherein the engagement member is L-shaped and, in use, is secured to the frame or the wall panel respectively engaging the hook-shaped portion of the retaining member.

6. A pressure relief wall apparatus as claimed in claim 5, wherein the wall panel comprises an exterior panel, a liner panel and Z-shaped members securing the exterior panel and the liner panel together.

7. A pressure relief wall apparatus as claimed in claim 6, wherein the said securing elements comprises a plurality of rivets, and wherein the exterior panel, the liner panel and the Z-shaped members are secured together by screws.

8. A pressure relief wall assembly comprising a wall panel the terminology having ends and sides with a central portion of the panel, in use, being permanently secured to a frame, and fastener means which comprises:

securing means comprising a plurality of elements, which, in use, releasably fasten the ends of the wall panel to the frame and which fail when a first excess pressure is applied to either side of the wall panel;

and at either end of the wall panel a retaining member, each of which includes a hook-shaped portion, and in use, is secured to the wall panel or the frame and does not obstruct deflection of said second end in one direction, but each of which, when excess pressure is applied to the other side of the wall panel, retains a respective end of the wall panel after failure of said elements, the hook-shaped portion deflecting and releasing the respective end to permit the applied pressure to dissipate, when a second excess pressure greater than the first excess pressure is applied to the other side of the panel after a further increase in the pressure applied to said other side of the wall panel above a second excess pressure greater than the first excess pressure.

9. A pressure relief wall assembly as claimed in claim 8, wherein each retaining member is L-shaped, one side of the retaining member including the hook-shaped portion and the other side thereof, in use, being secured to one end of the wall panel or the frame, and wherein the engagement member is L-shaped and, in use, is secured to the frame or the wall panel respectively and engages the hook-shaped portion of a respective retaining member.

10. A pressure relief wall assembly as claimed in claim 9, wherein at each end said elements comprise rivets between the retaining member and the engagement member.

11. A pressure relief wall assembly as claimed in claim 10, wherein the wall panel comprises an inner liner panel and an exterior panel.

12. A pressure relief wall assembly as claimed in claim 11, wherein the wall panel is generally rectangular.

13. A pressure relief wall assembly as claimed in claim 12, wherein the exterior panel is corrugated with the corrugations extending between the ends of the wall panel.

14. A pressure relief wall assembly as claimed in claim 13, wherein the wall panel includes a plurality of liner panels each of which includes complimentary coupling sections on opposite edges thereof with the coupling sections extending along the wall panel between the ends of the wall panel.

15. A pressure relief wall assembly as claimed in claim 14, wherein the exterior panel and the liner panels are coupled together by Z-shaped members which extend parallel to the ends of the wall panel and which are secured to the liner panels between their coupling sections.

16. A pressure relief wall apparatus as claimed in claim 15, which includes, between the exterior and interior panels, a Z-shaped member at either end of the wall panel and a Z-shaped member in the central portion of the panel.

17. A pressure relief wall apparatus as claimed in claim 15 which includes two Z-shaped members, which are parallel to the ends of the wall panel and which are secured to the exterior panel and portions of the coupling section of the liner panels closest to the exterior panel.

* * * * *